US005083017A

United States Patent [19]

Anno et al.

[11] Patent Number: 5,083,017

[45] Date of Patent: Jan. 21, 1992

[54] X-RAY IMAGE INTENSIFIER WITH UNITARY PLATE INPUT PHOSPHOR SCREEN

[75] Inventors: Hidero Anno, Ootawara; Katsuhiro Ono, Kawasaki, both of Japan

[73] Assignee: Kabushiki Kaisha Toshiba, Kawasaki, Japan

[21] Appl. No.: 444,795

[22] Filed: Dec. 1, 1989

[30] Foreign Application Priority Data

Dec. 2, 1988 [JP] Japan ..... 63-305785

[51] Int. Cl.[5] ..... H01J 31/50

[52] U.S. Cl. ..... 250/213 VT; 313/541

[58] Field of Search ..... 250/213 VT, 213 R; 313/541, 525

[56] References Cited

U.S. PATENT DOCUMENTS

| | | | |
|---|---|---|---|
| 2,827,571 | 3/1958 | Klasens et al. . | |
| 4,611,144 | 9/1986 | Minami | 250/213 VT |
| 4,847,482 | 7/1989 | Kubo | 250/213 VT |
| 4,855,589 | 8/1989 | Enck et al. | 250/213 VT |
| 4,893,020 | 1/1990 | Ono | 250/213 VT |

FOREIGN PATENT DOCUMENTS

| | | |
|---|---|---|
| 0215699 | 3/1987 | European Pat. Off. . |
| 0242024 | 10/1987 | European Pat. Off. . |
| 0272581 | 6/1988 | European Pat. Off. . |
| 48-2465 | 1/1973 | Japan . |
| 51-127668 | 11/1976 | Japan . |

OTHER PUBLICATIONS

RCA Review–An X-Ray-Sensitive Fiber-Optic Intensifier Screen for Topography, R. W. Smith.

*Primary Examiner*—David C. Nelms
*Assistant Examiner*—Le: Que Tan
*Attorney, Agent, or Firm*—Cushman, Darby & Cushman

[57] ABSTRACT

An X-ray image intensifier has an input phosphor screen with a substrate in which a large number of small holes are formed, and a fluorescent material filled in the small holes. A ratio of a maximum inner diameter to a depth of each small hole is set to be 0.5 or less. Alternatively, the input phosphor screen of the X-ray image intensifier of the invention includes a substrate in which a large number of small holes are formed, a low-refractive-index material layer formed on the inner wall of each small hole, and a fluorescent material having a refractive index higher than the low-refractive-index material layer filling each small hole. The input phosphor screen of the X-ray image intensifier of the invention is manufactured by forming a large number of small holes in a substrate composed of photosensitive glass, forming the substrate into an arcuated shape by hot pressing, converting the substrate into crystallized glass by a heat treatment, and obtaining an input phosphor screen by filling the small holes with a fluorescent material.

8 Claims, 6 Drawing Sheets

X-RAY IMAGE INTENSIFIER WITH UNITARY PLATE INPUT PHOSPHOR SCREEN

BACKGROUND OF THE INVENTION

1. Field of the Invention

The present invention relates to an X-ray image intensifier and a method of manufacturing the same and, more particularly, to an improvement of an input phosphor screen of the X-ray image intensifier.

2. Description of the Related Art

A system for observing an object to be imaged by using an X-ray image intensifier generally has an arrangement shown in FIG. 1. An X-ray image intensifier 2 is placed in front of an X-ray source 1. A X-ray beam which becomes modulated as it is transmitted through an object 3 to be imaged is incident on the X-ray image intensifier 2. An output image obtained in the X-ray image intensifier 2 is observed through an imaging camera and can be reproduced on a monitor TV.

In this case, an input screen 4 is arranged at one end of the X-ray image intensifier 2, and an output phosphor screen 5 is arranged at the other end of the image intensifier 2 so as to oppose the input screen 4. During an operation of the system, a modulated X-ray image is converted into an optical image by the input screen 4. This optical image is then converted into a photoelectronic image. When the photoelectronic image is focused and accelerated, a luminance-intensified output image is obtained on the output phosphor screen 5. This output image is observed through, e.g., an imaging camera.

The input screen 4 of the conventional X-ray image intensifier 2 has an arrangement shown in FIG. 2. A phosphor layer 8 constituted by columnar crystals 7 consisting of a CsI:Na phosphor is formed on the concave surface of a spherical aluminum substrate 6. The input phosphor screen is constituted by the aluminum substrate 6 and the phosphor layer 8. A photoelectric screen 10 is formed on the phosphor layer 8 of the input phosphor screen through an intermediate layer 9 consisting essentially of aluminum oxide and indium oxide layers.

In order to reduce exposure of the object 3 to X-rays, X-rays which are transmitted through the object must be input in the phosphor layer 8 without a loss to increase an absorption amount of the X-rays. With regard to the phosphor layer 8, in order to increase the X-ray absorption amount, the phosphor columnar crystals 7 are preferably elongated. However, if the columnar crystals 7 are elongated, the length of light propagation from a side surface of a given columnar crystal 7 to another columnar crystal 7 is increased, resulting in a decrease in resolution. For this reason, the columnar crystals 7 cannot be elongated much, and the maximum length of each columnar crystal is about 400 μm.

Attempts to solve the above-described problem have been made. For example, Published Examined Japanese Utility Model Application No. 48-2465 discloses a phosphor screen manufactured by forming a light-reflecting layer on the inner wall of each through hole of a fiber plate formed by laterally stacking a large number of tubular fibers, and embedding a fluorescent material in each through hole.

In this case, light emitted when the fluorescent material of each fiber absorbs X-rays is not transmitted through another adjacent fiber, but can reach the surface while being confined in the fiber. Therefore, if the diameter of each fiber is sufficiently decreased, a high-resolution phosphor screen is theoretically obtainable.

Intensifying screens used for X-ray diagnosis, however, currently have a maximum screen size of 14 inches. The view field diameter of the input screen of each X-ray image intensifier is six inches or more, and reaches a maximum of 22 inches. If such a large-diameter input screen is manufactured by the method disclosed in Published Examined Japanese Utility Model Application No. 48-2465, the manufacturing cost becomes prohibitive. Hence, such a method cannot be practically used.

If a commercially available fiber plate is used, and its core is removed by chemical etching, a plate without a core can be easily formed. After light-reflecting coating layers are formed on the inner walls of small holes in the fiber plate whose core is removed, the holes are filled with a phosphor, thereby obtaining an input phosphor screen with a high resolution.

In order to manufacture a fiber plate having a diameter of six inches or more, an enormous cost is required, and the manufactured plate would have insufficient heat resistance. Therefore, such a plate cannot be applied to the input phosphor screen of an X-ray image intensifier.

In addition, Japanese Patent Disclosure (KOKAI) No. 51-127668 discloses an input phosphor screen that is obtained by forming a large number of small holes in a metal substrate by chemical etching and filling the small holes with a phosphor, and the obtained input phosphor screen is used as the input screen of an X-ray image intensifier.

If, however, small holes are to be formed in a metal substrate by chemical etching, it is very difficult to set the ratio of the maximum inner diameter to the depth of each small hole to be one or less by using any available technique. For example, if the depth of each small hole is set to be 400 μm in accordance with a thickness of 400 μm (of a substrate) which is required when a fluorescent material to be filled in small holes is a phosphor containing CsI as a major component, the sectional size of each small hole can only be reduced to about 400 μm.

An input phosphor screen, therefore, obtained by forming a large number of small holes each having a diameter of 400 μm and a depth of 400 μm in a metal substrate, and filling the small holes with a CsI phosphor has a limit resolution of about 20 lp/cm. In comparison with a limit resolution of 50 to 100 lp/cm of an existing 400 μm thick CsI input phosphor screen, the resolution characteristics of the above-described input phosphor screen are expected to be greatly degraded.

In an RCA Review, "An X-Ray Sensitive Fiber Optic Intensifier Screen for Topography" is described by R. W. Smith. This article describes a phosphor screen obtained by removing the core portion of a fiber plate by etching to form small holes, and filling the small holes with a melted CsI:Na phosphor.

In order to apply this phosphor screen to an X-ray image intensifier for medical diagnosis, a fiber plate having a diameter of 6 inches or more is required. However, such a fiber plate is very expensive and hence is not suitable for practical applications. In addition, since a fiber plate has a low melting point, if a phosphor is melted and filled, the depth of each small hole is undesirably limited.

SUMMARY OF THE INVENTION

It is an object of the present invention to provide a low-cost, highly reliable X-ray image intensifier having a high X-ray absorption and an increased resolution (contrast), and a method of manufacturing the same.

According to the present invention, there is provided an X-ray image intensifier wherein an input phosphor screen comprises a substrate consisting of a material which allows at least etching and having a large number of small holes formed therein, and a fluorescent material filled in the small holes, the ratio of the maximum inner diameter to the depth of each hole being set to be 0.5 or less.

In addition, according to the present invention, there is provided an X-ray image intensifier, wherein an input phosphor screen comprises a substrate consisting of a material which allows at least etching and having a large number of small holes formed therein, a low-refractive-index material layer formed in the inner wall of each small hole, and a fluorescent material filled in the small holes.

Moreover, according to the present invention, there is provided a method of manufacturing an X-ray image tube, comprising at least the following steps:

(1) the step of forming a large number of small holes in a substrate consisting of photosensitive glass;

(2) forming the substrate into an arcuated shape by hot pressing;

(3) converting said substrate into crystallized glass by a heat treatment; and (4) obtaining an input phosphor screen by filling the small holes with a fluorescent material.

In the X-ray image intensifier having the above-described arrangement, light which is emitted when the fluorescent material filling each small hole absorbs X-rays is repeatedly reflected by the inner wall of the small hole and propagates in the small hole to its surface with almost no intensity attenuation. Therefore, fluorescent light does not diffuse beyond the diameter of each small hole in a direction parallel to the phosphor screen. For this reason, a limit resolution higher than that of a conventional X-ray image intensifier can be obtained. In addition, since no light diffusion occurs, MTF can be greatly increased even in an intermediate spatial frequency band.

DETAILED DESCRIPTION OF THE PREFERRED EMBODIMENTS

An X-ray image intensifier of the present invention has an input screen on the input side of a vacuum envelope, and an output phosphor screen on the output side of the envelope, which opposes the input screen. The input screen consists of an input phosphor screen and a photoelectric screen. An improved input phosphor screen will be described below.

Two embodiments will be described below. The first embodiment will be described first. The second embodiment will be described next.

First Embodiment

Figure 1:
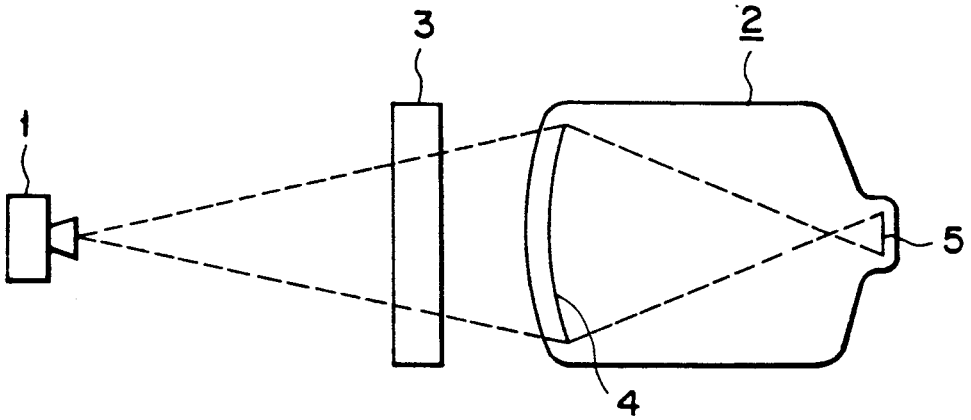
FIG. 1 is a sectional view showing a system for observing an object to be imaged, which employs a conventional X-ray image intensifier.
Figure 2:
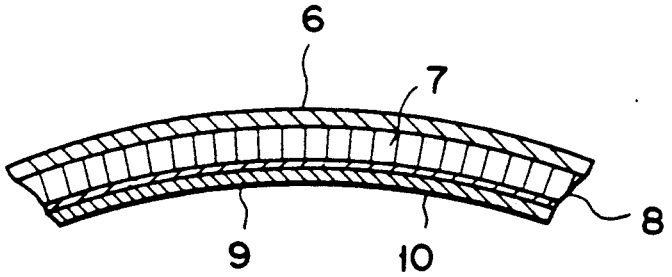
FIG. 2 PRIOR ART
FIG. 2 is an enlarged sectional view showing an input phosphor screen of the conventional X-ray image intensifier.
Figure 3:
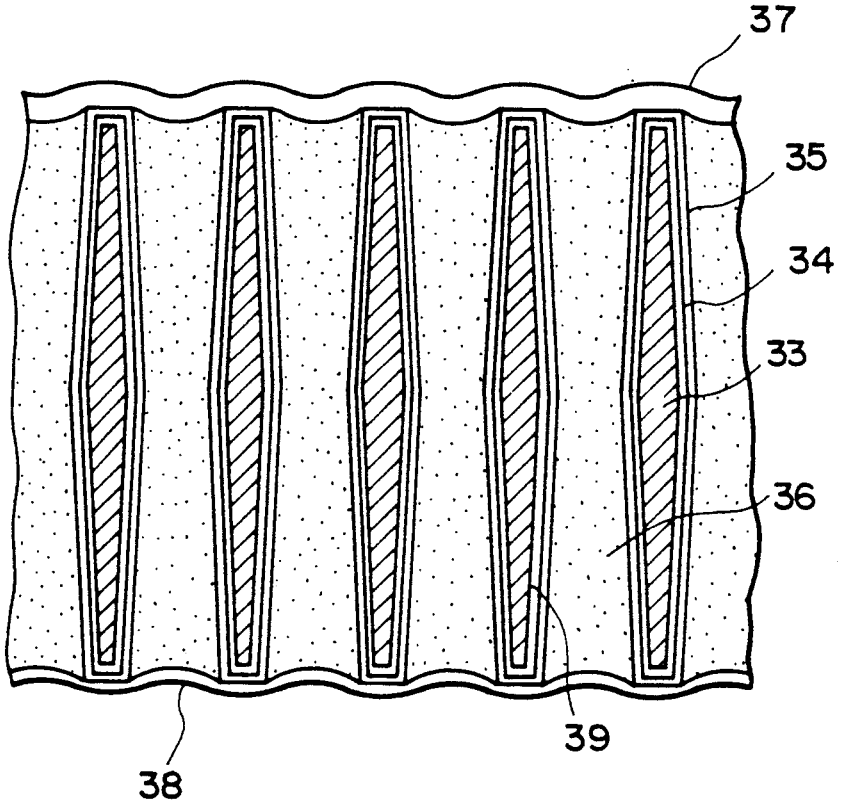
FIG. 3 is an enlarged sectional view showing an input phosphor screen of an X-ray image intensifier according to an embodiment of the present invention.

An input phosphor screen 31 in the first embodiment has an arrangement shown in FIG. 3. Referring to FIG. 3, reference numeral 33 denotes a substrate consisting of crystallized glass A large number of small holes 39, having inner walls defined by surfaces 39*a*, are formed in the substrate 33 by a method to be described later. The inner diameter of each small hole 39 is small near the middle and becomes larger toward both the ends. The ratio of the maximum inner diameter to the depth of each hole is set to be 0.5 or less.

A light-reflecting layer 34 and a low-refractive-index material layer 35 are sequentially stacked and formed on the inner wall 39*a* of each small hole 39. The low-refractive-index material layer 35 is composed of a transparent material having a smaller refractive index with respect to the wavelength of light emitted from a fluorescent material (to be described later) than the refractive index of the fluorescent material. A fluorescent material, e.g., a CsI phosphor 36 is filled in each small hole 39 having an inner wall 39*a* on which the layers 34 and 35 are formed.

An aluminum deposition layer 37 used as a light-reflecting coating is formed on one surface (input side) of the substrate filled with the CsI phosphor 36, and a transparent conductive film 38 consisting of indium-tin-oxide (ITO) is formed on the other surface of the substrate 33 (output side). Photoelectric screen 32 is formed on transparent conductive film 38 of input phosphor screen 31 having a structure as stated above.

A method of manufacturing the above input phosphor screen 31 will be described below.

Figure 4:
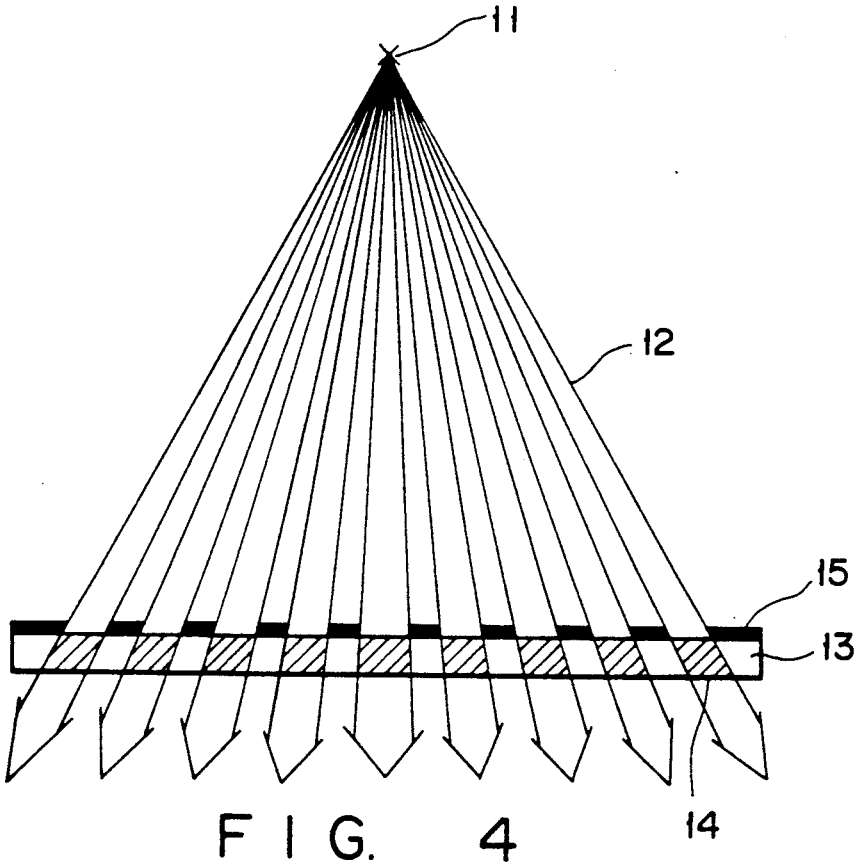
FIGS. 4 to 7 are sectional, plane, sectional, and sectional views, respectively, showing a method of manufacturing an X-ray image intensifier (a method of manufacturing a substrate) according to a embodiment of the present invention.

A substrate element 13 shown in FIG. 4 is used as a substrate 33. The substrate element 13 is constituted by photosensitive glass consisting of silicon oxide as a major component. The substrate element 13 has a thickness of 0.7 mm and a disk-like shape. The upper and lower surfaces of the substrate element 13 are finished by mirror polishing. Thus, those skilled in the art will realize that substrate element 13 is a unitary plate.

Figure 5:
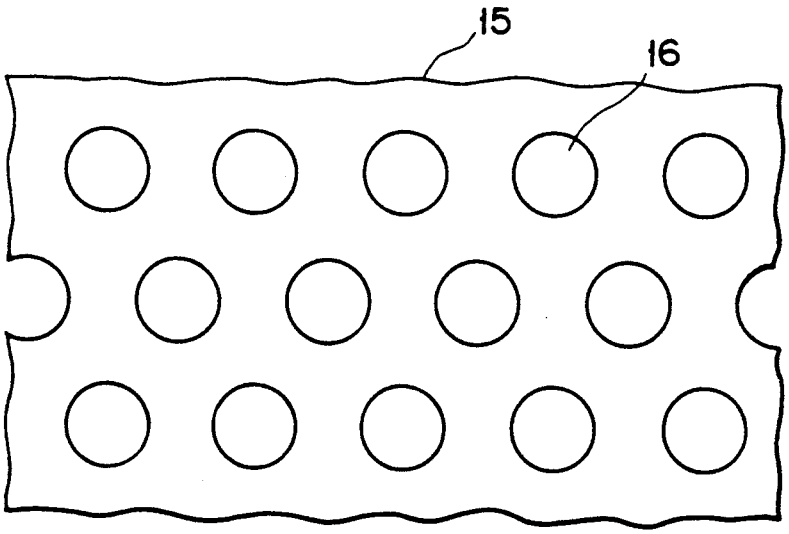

A large number of small holes 39 are formed in the substrate element 13 by photoetching. In this case, a photomask 15 shown in FIG. 5 is used. The photomask 15 can be easily obtained by forming a large number of small through holes 16 each having a diameter of 60 μm in a stainless steel plate having a thickness of, e.g., about 0.1 mm by photoetching.

The photomask 15 is placed in tight contact with one surface of the substrate element 13, and ultraviolet light 12 is radiated from an ultraviolet point light source 11 onto the substrate element 13, as shown in FIG. 4. Part of the radiated ultraviolet light 12 is transmitted through each through hole 16 of the photo-mask 15 and radiated on the substrate element 13. As a result, the photosensitive glass of the substrate element 13 is exposed to the ultraviolet light 12 and forms latent images 14. Note that the distance from the ultraviolet light source 11 to the substrate element 13 is set to be substantially equal to an average curvature radius to be set in the process of curving the substrate (to be described later).

After the process of forming the latent images, the substrate element 13 is heat-treated in the temperature range of 400° to 600° C. so as to crystallize the portions where the latent images 14 are formed, thus allowing the portions to be easily eroded by an acid in an etching process to be described later (developing process). In addition, in preparation for a heat-treatment process for crystallization to be described later, ultraviolet light is radiated on the entire surface of the substrate element 13 (re-exposure process).

The latent image regions which are crystallized so as to be easily eroded by an acid are etched by spraying a dilute hydrofluoric acid on the upper and lower surfaces of the substrate element 13. The etching rate of each latent image region which is crystallized so as to be easily eroded by an acid is 30 to 60 times that of a non-latent image region due to the characteristics of the photosensitive glass.

Figure 6:
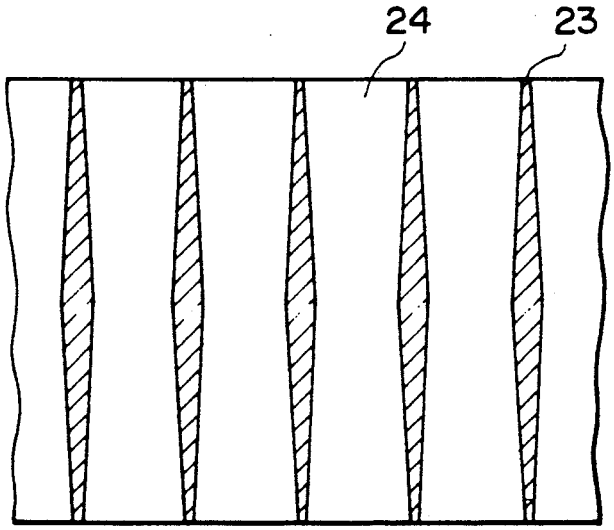

For this reason, the rate at which the depth o each hole formed by etching is increased as etching time increases is 30 to 60 times the rate at which the diameter of the hole is increased. Upon completion of the etching process, therefore, a substrate 23 in which a large number of through holes 24 (corresponding to the small holes 39 of the substrate 33) as shown in FIG. 6 are formed. The thickness of the obtained substrate 23 is about 0.6 mm, and the diameter of each through hole 24 is about 90 to 95 μm. The occupation ratio of the through holes 24 with respect to the entire volume is about 73%.

Figure 7:
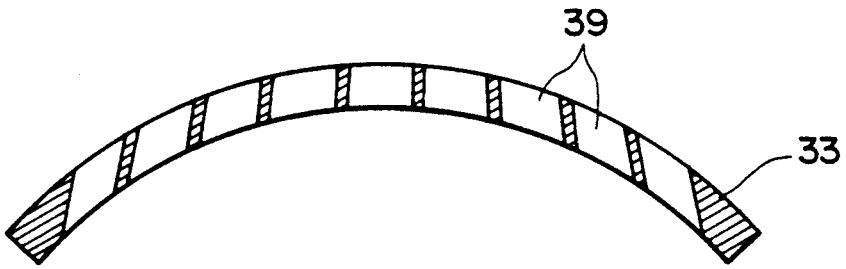

Subsequently, the substrate 23 is hot-pressed in the temperature range of 500° to 900° C. so as to be formed into an input screen shape of an X-ray image intensifier, i.e., an arcuated shape, as shown in FIG. 7. In addition, in the heat treatment during this formation process, crystallization of the photosensitive glass progresses, thus finally resulting in a substrate 33 consisting of crystallized glass which does not soften at a temperature of 700° C. or more and having a large number of small holes 39.

As shown in FIG. 3, a light-reflecting member is coated on the inner wall 39*a* of each small hole 39 of the substrate 33 to form a light-reflecting layer 34. The light-reflecting layer 34 can be obtained by coating a platinum film to a thickness of 2 to 3 μm using a well known baking varnish called liquid platinum.

After the light-reflecting layer 34 is formed on the inner wall 39*a* of each small hole 39 of the substrate 33, a silicon oxide film is stacked on the layer 34 to a thickness of about 1 μm. A low-refractive-index material layer 35 is formed on the resultant structure by repeating a series of processes of applying an alcohol solution of a polysiloxane polymer which is well known in the field of the manufacture of semiconductor elements, and heat-treating the structure in the air. Projections of 1 to 2 μm are formed on the inner wall 39*a* of each small hole 39 formed by etching, i.e., the inner wall is very coarse. However, since the light-reflecting layer 34 and the low-refractive-index material layer 35 are coated, smoothness of the screen is improved.

A CsI phosphor 36 is deposited on the concave surface side of the substrate 33 to a uniform thickness by vapor deposition.

Subsequently, the substrate 33 on with the CsI phosphor 36 is deposited in a vacuum is heated to a temperature (630° to 680° C.) slightly higher than the melting point of the CsI phosphor 36 to melt the CsI phosphor 36 and thus fill each small hole 39 of the substrate 33. By ensuring that the temperature of the substrate 33 is raised and lowered at a sufficiently high rate, evaporation loss of the CsI phosphor 36 can be prevented.

In addition, the deposition film thickness of the CsI phosphor 36 must be selected to allow each hole 39 of the substrate 33 to be almost completely filled with the CsI phosphor 36 and to allow no residue of the CsI phosphor 36 outside each small hole 39.

After the small holes 39 of the substrate 33 are filled with the CsI phosphors 36 in this manner, a light-reflecting member, e.g., an aluminum deposition layer 37 is formed on the convex surface side of the substrate 33, on which X-rays are incident. When a transparent conductive film 38 is formed on the concave surface side on which a photoelectric screen 32 is to be formed, an input phosphor screen 31 is obtained.

After the input phosphor screen 31 obtained in this manner is incorporated in the X-ray image intensifier, a photoelectric screen 32 is formed on input phosphor screen 31, thereby forming an input screen.

In the above-described X-ray image intensifier of the present invention, the refractive index of the fluorescence wavelength of the CsI phosphor 36 is about 1.84. The refractive index of the fluorescence wave-length of the low-refractive-index material layer 35, i.e., the silicon oxide film is about 1.46. Therefore, part of light which is emitted when the CsI phosphor 36 filling in each small hole 39 of the substrate 33 absorbs X-rays is repeatedly total-reflected by interface between the low-refractive-index material layer 35 and the CsI phosphor 36, and propagates in the small hole 39 to be incident on the photoelectric screen 32 almost no intensity attenuation. Similarly, the remaining fluorescent light is repeatedly reflect the surface of the light-reflecting layer 34 which platinum coating layer, and is effectively incident on the photoelectric screen 32 without diffusing to the adjacent holes 39.

In accordance with a decrease in volume occupation ratio of the small holes 39, the volume occupation ratio of the CsI phosphors 36 to be filled in the small holes is decreased to about 70%. However, since each small hole 39 has a depth of 600 μm, the same X-ray absorptance as that of a 400 μm thick CsI phosphor layer formed by a conventional vapor deposition method can be ensured. In addition, since the CsI phosphors 36 were melted and filled in the small holes 39, the transmittance with respect to fluorescent light is higher than that of the conventional deposition film.

Furthermore, the surface of the input phosphor screen 31 (the side on which the photoelectric screen 32 is formed) is substantially a perfectly continuous surface. Therefore, sensitivity of the photoelectric screen 32 to be formed on the surface of the transparent conductive film 38 is higher than that in the conventional technique.

Since light emitted from the CsI phosphor 36 filling each small hole 39 having a diameter of about 90 μm, did not diffuse/propagate outside the small hole 39 at all, blurring due to light diffusion occurring in the conventional input phosphor screen completely disappears.

In addition, since the longitudinal direction of each small hole 39 was substantially aligned with the incident direction of X-rays, blurring of fluorescent light due to oblique X-ray incidence which is experienced in the conventional input phosphor screen disappears.

According to the first embodiment, in comparison with the conventional input phosphor screen, the limit resolution was increased from 50 lp/cm to 56 lp/cm; the MTF value at a spatial frequency of 20 lp/cm, from 25% to 60%; and the limit resolution at a peripheral position, from 46 lp/cm to 54 lp/cm.

Moreover, the sensitivity was not degraded as compared with the conventional technique. In the X-ray image intensifier of the present invention, the inner diameter of each small hole 39 is small at its middle portion and increased toward both the ends. With this configuration, the CsI phosphor 36 filling the small hole 39 does not easily drop off, and guide efficiency of light is good.

Second Embodiment

Figure 8:
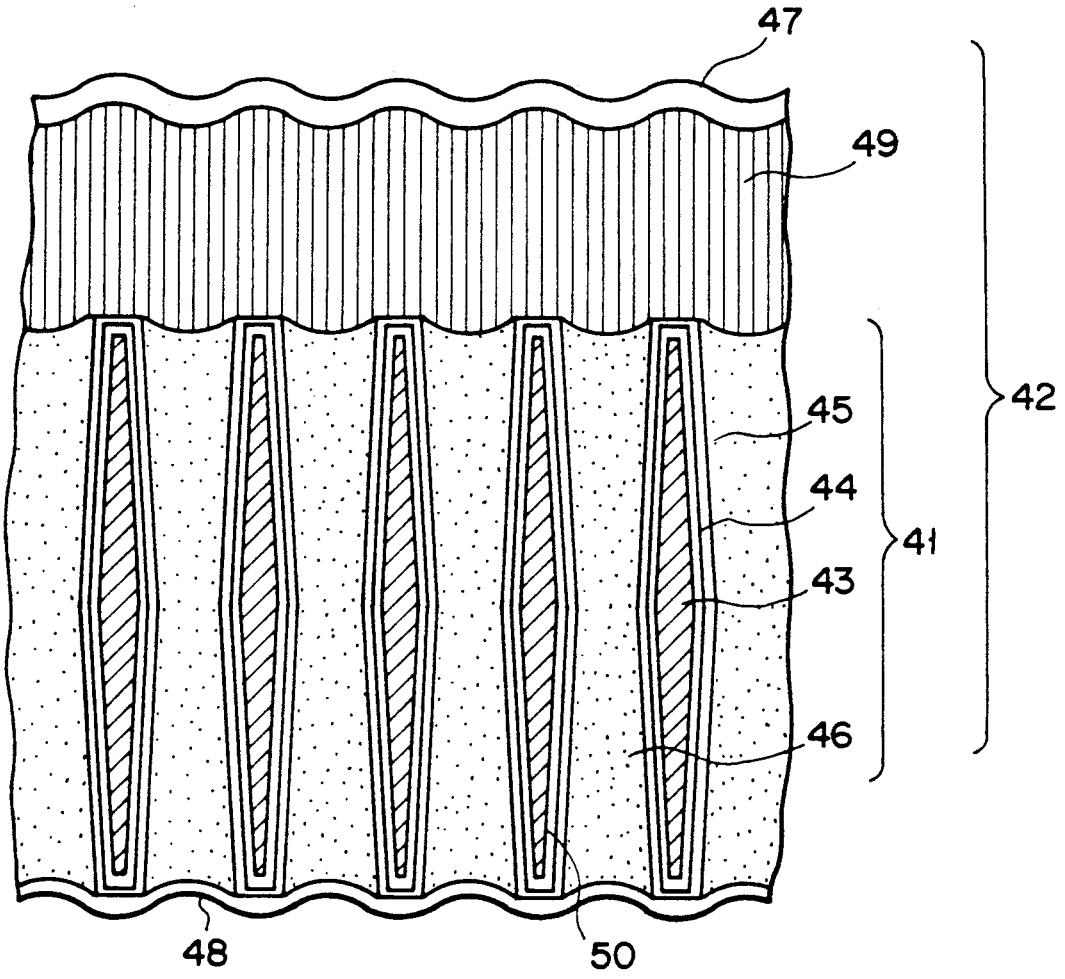
FIG. 8 is an enlarged sectional view showing an input phosphor screen of an X-ray image intensifier according to another embodiment of the present invention.

FIG. 8 shows an input phosphor screen according to the second embodiment of the present invention.

Referring to FIG. 8, a first phosphor screen 41 is an input phosphor screen obtained by filling CsI phosphors 46 in small holes 50, having inner walls defined by surfaces 50*a*, of a substrate 43 consisting of crystallized glass in accordance with the same procedure as that in the first embodiment. In this case, however, an aluminum deposition layer used as a light-reflecting coating is not formed on the convex surface side. In FIG. 8, reference numeral 44 denotes a light-reflecting layer; and 45, a low-refractive-index material layer.

In addition, reference numeral 49 denotes a second phosphor screen consisting of a CsI phosphor stacked on the convex surface side of the first phosphor screen 41 by a conventional vapor deposition method. The film thickness distribution of the second phosphor screen 49 is adjusted such that when an input phosphor screen 42 formed by the first and second phosphor screen 41 and 49 is incorporated in an X-ray image intensifier and X-ray photography is performed, the thickness of the input phosphor screen 42 allows uniform X-ray absorptance characteristics at any position of the screen 42.

Figure 9:
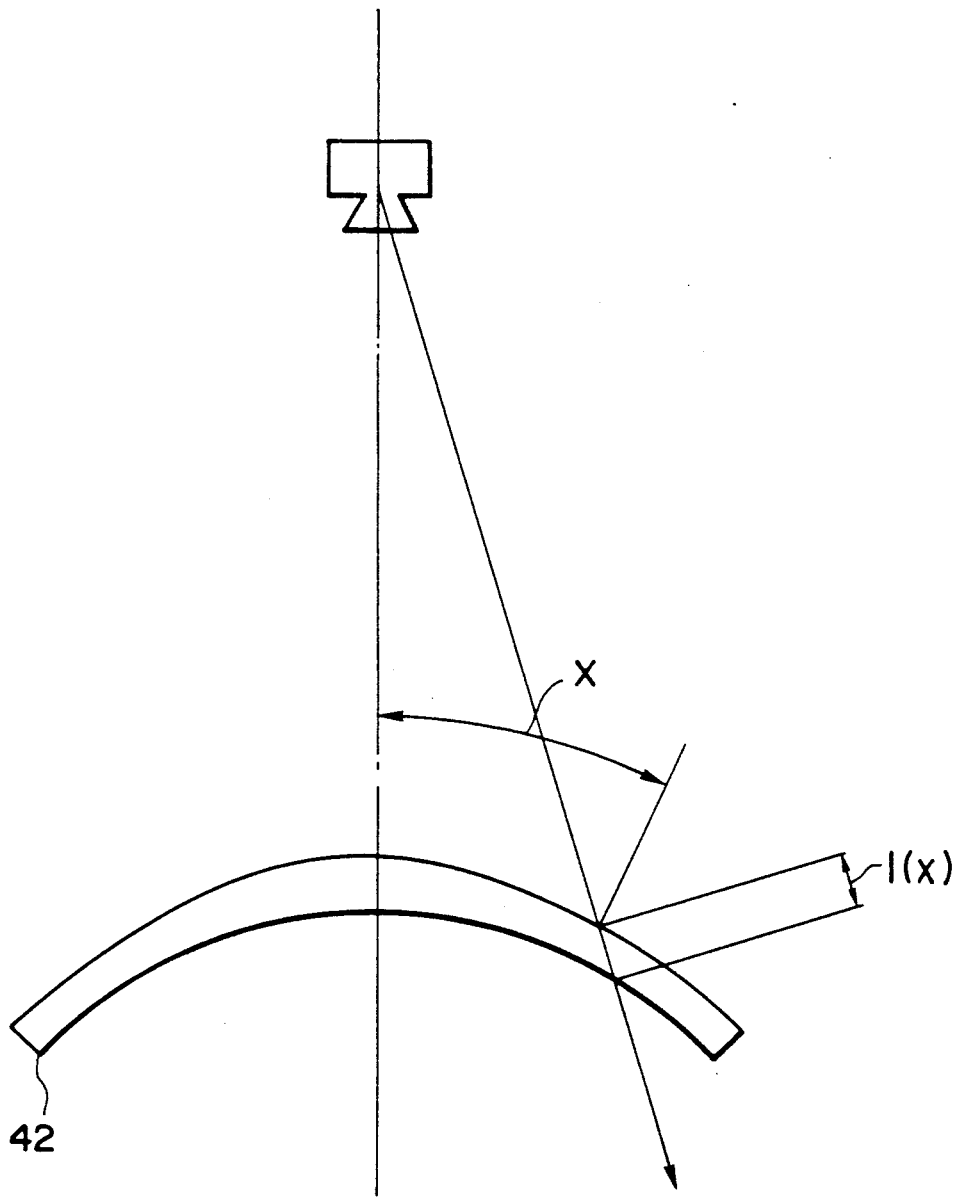
FIG. 9 is a view for explaining a relationship between the input phosphor screen in FIG. 8 and X-rays from an X-ray intensifier.

As shown in FIG. 9, the film thickness distribution of the second phosphor screen 49 is selected such that a distance l(x) which is obtained when an X-ray passing through an arbitrary position x of the input phosphor screen 42 is transmitted through the screen 42 is set to be constant regardless of the value of x. More specifically, the film thickness distribution is adjusted such that the thickness of the second phosphor screen 49 is set to be 250 μm at the center position (x=0) and to be decreased toward the periphery.

An aluminum deposition layer 47 as a light-reflecting coating is formed on the surface (convex surface side) of the second phosphor screen 49. In addition, a transparent conductive film 48 is formed on the surface (concave surface side) of the first phosphor screen 41.

After the above input phosphor screen 42 is incorporated in the X-ray image intensifier, photoelectric screen 51 is formed on the input phosphor screen 42, thus obtaining an input screen.

In the second embodiment, the first phosphor screen 41 which can reduce blurring due to fluorescent light diffusion compared with a conventional screen and the second phosphor screen 49 which has a smaller thickness than a conventional screen are stacked on each other. With this configuration, blurring due to fluorescent light diffusion can be reduced as compared with the conventional input phosphor screen having a thickness of about 400 μm.

Since the phosphor layer has a large thickness of 850 μm compared with a film thickness of 400 μm in the conventional technique, the X-ray absorptance is increased. The X-ray absorption characteristics can be made uniform at the central and peripheral portions.

In the second embodiment, the limit resolution was increased from 50 to 52 lp/cm in comparison with the conventional technique; and the MTF value at a spatial frequency of 20 lp/cm, from 25 to 30%.

In addition, in comparison with the conventional technique, the same image quality was obtained with a smaller X-ray amount. When the incident X-ray amount remained the same, an X-ray image having less noise was obtained as compared with the conventional technique.

When energy subtraction photography was performed using the X-ray image intensifier, an image having uniform image quality from the center to the periphery was obtained.

Since the phosphor layer had a large thickness, the sensitivity was increased by 10 to 20% compared with the conventional technique.

In the first and second embodiments, the small holes 39 and 50 are through holes. However, non-through holes may be employed.

In addition, in the first and second embodiments, after a large number of small holes are formed in a substrate consisting of photosensitive glass, the substrate was formed into an arcuated shape by hot pressing. However, after a substrate is formed into an arcuated shape by hot pressing upon developing and re-exposure processes, small holes may be formed in the substrate by etching.

In this case, however, after the etching process, the substrate must be heat-treated in the temperature range of 700° to 900° C. again so as to be crystallized.

In the first and second embodiments, the light-reflecting layers 34 and 44 are directly formed on the inner walls of the small holes 39*a* and 50*a*, respectively. However, these layers may be indirectly formed on the inner walls.

Moreover, in the first and second embodiments, the low-refractive-index material layers 35 and 45 are formed on layers 34 and 44, respectively. However, these layers may be directly formed on the inner walls.

In this case, fluorescent light components which are not totally reflected by the interfaces between the low-refractive-index material layers 35 and 45 and the CsI phosphors 36 and 46 are absorbed by the substrates 33 and 43, respectively, and are eliminated. Therefore, the resolution characteristics can be improved as in the above-described embodiments.

As has been described above, according to the X-ray image intensifier of the present invention, a high X-ray absorption can be obtained, and light which is emitted when a fluorescent material filling each hole absorbs X-rays is repeatedly reflected by the inner wall of the hole, and propagates in the hole to reach its surface.

Fluorescent light, therefore, does not diffuse beyond the diameter of each small hole in a direction parallel to the screen. As a result, a high limit resolution can be obtained as compared with the conventional technique. In addition, since no light diffusion occurs, the MTF value can be greatly increased even in an intermediate spatial frequency band.

What is claimed is:

1. An X-ray image intensifier comprising:

an input phosphor screen for converting an incident X-ray image into a fluorescent image, the input phosphor screen including a glass substrate in the form of a unitary plate, having a large number of holes with a predetermined maximum inner diameter and depth, respectively, and a fluorescent material filling the small holes, a ratio of the maximum inner diameter to the depth of each of the small holes being set to be not more than 0.5;

a photoelectric screen for converting the fluorescent image into a photoelectric image formed on the input phosphor screen; and an output screen for converting photoelectric image into the fluorescent image.

2. An X-ray image intensifier comprising:

an input phosphor screen for converting an incident X-ray image into a fluorescent image;

the input phosphor screen including a substrate having a large number of small holes, a low-refractive-index material layer formed on an inner wall of each of the small holes, a fluorescent material, filling each of the small holes, having a refractive index higher than the low-refractive-index material layer;

a photoelectric screen for converting the fluorescent image into a photoelectric image formed on the input phosphor screen; and an output screen for converting photoelectric image into the fluorescent image.

3. An image intensifier according to claim 1 or 2, wherein the photoelectric image indirectly formed on the input phosphor screen.

4. An image intensifier according to claim 1 or 2, wherein a material for the substrate is crystallized glass.

5. An image intensifier according to claim 2, wherein the fluorescent material is a CsI phosphor.

6. An image intensifier according to claim 1 or 2, wherein an inner diameter of each of the small holes is small at a middle portion and is gradually increased toward both ends.

7. An image intensifier according to claim 1, wherein a low-refractive-index material layer is formed on an inner wall of each of the small holes.

8. An image intensifier according to claim 1, wherein the said fluorescent material, filling each of the small holes, has a refractive-index higher than a low-refractive-index material layer.

* * * * *